United States Patent [19]

Sanford

[11] 4,393,857

[45] Jul. 19, 1983

[54] COLLAPSIBLE GRILL

[76] Inventor: Richard Sanford, Rte. 2, Potsdam, N.Y. 13676

[21] Appl. No.: 246,915

[22] Filed: Mar. 23, 1981

[51] Int. Cl.[3] ..... F24C 1/16

[52] U.S. Cl. ..... 126/9 R; 126/30; 52/645; 99/449

[58] Field of Search ..... 126/29, 30, 9 R, 9 A, 126/9 B; 99/449; 52/645

[56] References Cited

U.S. PATENT DOCUMENTS

| | | | |
|---|---|---|---|
| 3,461,634 | 8/1969 | Earl | 99/449 |
| 3,837,328 | 9/1974 | Schaffer | 126/9 R |
| 4,109,567 | 8/1978 | Gage et al. | 126/30 |

*Primary Examiner*—Ronald C. Capossela

[57] ABSTRACT

A collapsible grill comprises a plurality of rods which are attached at their ends to a pair of flexible cables. A pair of bars are attached by several turns to the respective ends of the first rod and constrained to prevent escape from near the ends by a pair of pins in the first rod near its ends. The bars have hooks which engage detents on the last rod, which may be formed of indentations or the like, so that when assembled for use, the bars are held by the spring action of the last bar and the first bar to place the bars under compression and the cables under tension. The grid is thus spread out for use. One or more additional cables may be attached to the rods. The rods may have handles at the end remote from the turns formed by a simple fold-back of the ends. Forked stakes may be used to support the grill during use.

When not in use, the hooks may be disengaged, the bars and rods made near parallel and rolled up held by the chains, and constrained by a hook on the last bar to be retained in a bundle.

9 Claims, 6 Drawing Figures

COLLAPSIBLE GRILL

FIELD OF INVENTION

The present invention relates to collapsible grills.

BACKGROUND OF THE INVENTION

Collapsible grills are known. Such grills desirably are light in weight, easy to transport, and easy to assemble and disassemble. A portable grill may be exemplified by the grill described in U.S. Pat. No. 3,461,634 to Earl.

SUMMARY OF THE INVENTION

According to the invention, a collapsible grill comprises a plurality of rigid rods, a pair of flexible cables, which may be a chain or cable if desired, and a pair of rigid bar members. Each of the rods is fastened at one end to one of the cables and at the other end to the other of the cables in like order beginning at one end of each cable and continuing to the other end, so that when both cables are extended, the rods form an array of spaced rods. One rigid rod is loosely connected near its one end to one end of a first bar member, and is loosely fastened near its other end to one end of a second rigid bar. The bar members each have a receiving hook formed thereon to removably receive the other outermost rigid rod remote along said cables from said first outermost bar with the remaining plurality of rod members intervening in the cables between the first and second outermost rods. The other outermost rod includes a pair of indentations to form detents respectively for the bar hooks when engaged. When the hooks receive and engage the second bar member, the rods are parallel and under compression and the cables are under tension to spread the rods into an array useful as a grill. When the rods are disengaged from the hooks, the grill is collapsed and the rod members rolled up with the bars to form a compact, single easily portable bundle.

DESCRIPTION OF THE DRAWING

The various objects, advantages and novel features of the invention will be more fully apparent from the following description when read in connection with the accompanying drawing in which like reference numerals refer to like parts and in which.

DETAILED DESCRIPTION

Figure 1:
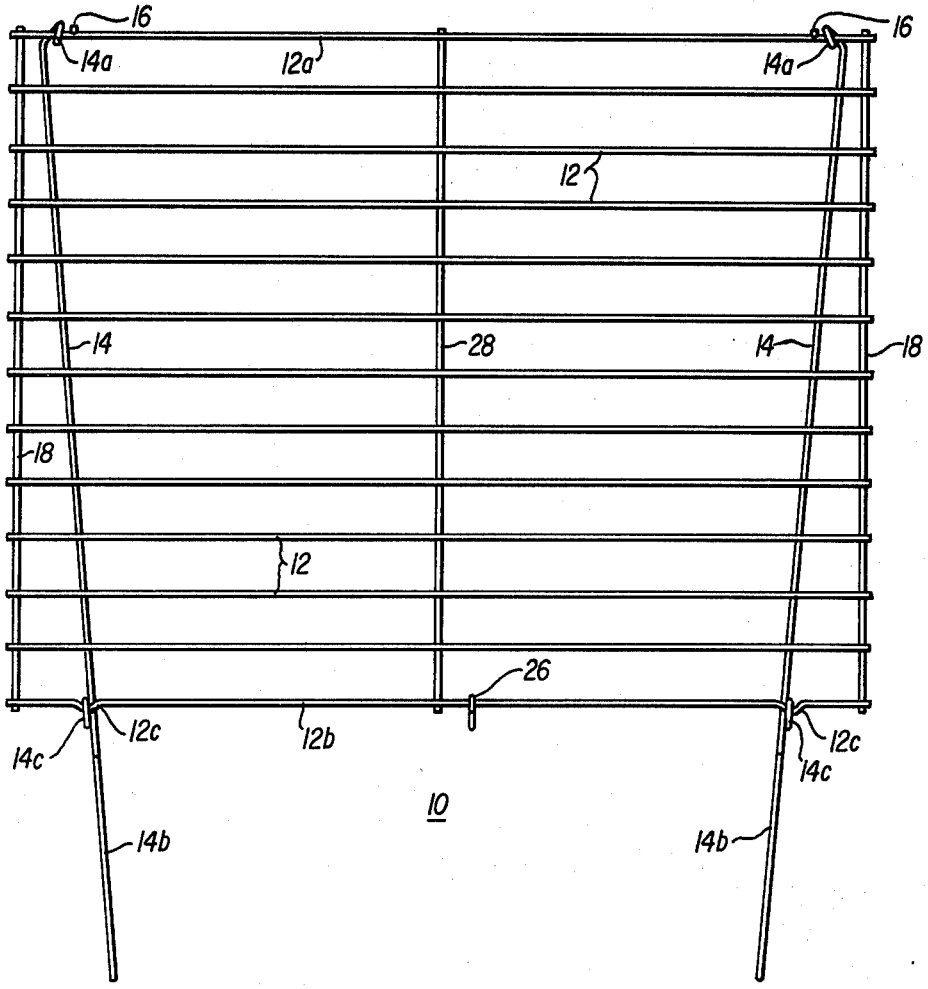
FIG. 1 is a plan view of a grill embodying the invention when assembled as a grill.
Figure 2:
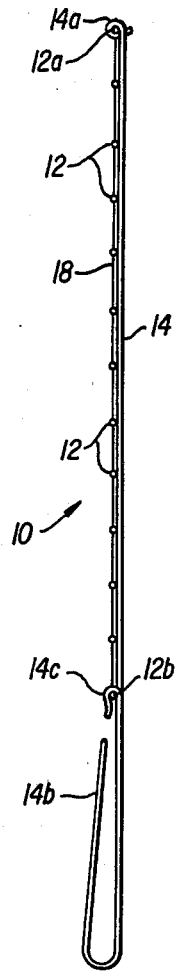
FIG. 2 is a side view of the grill of FIG. 1.
Figure 3:
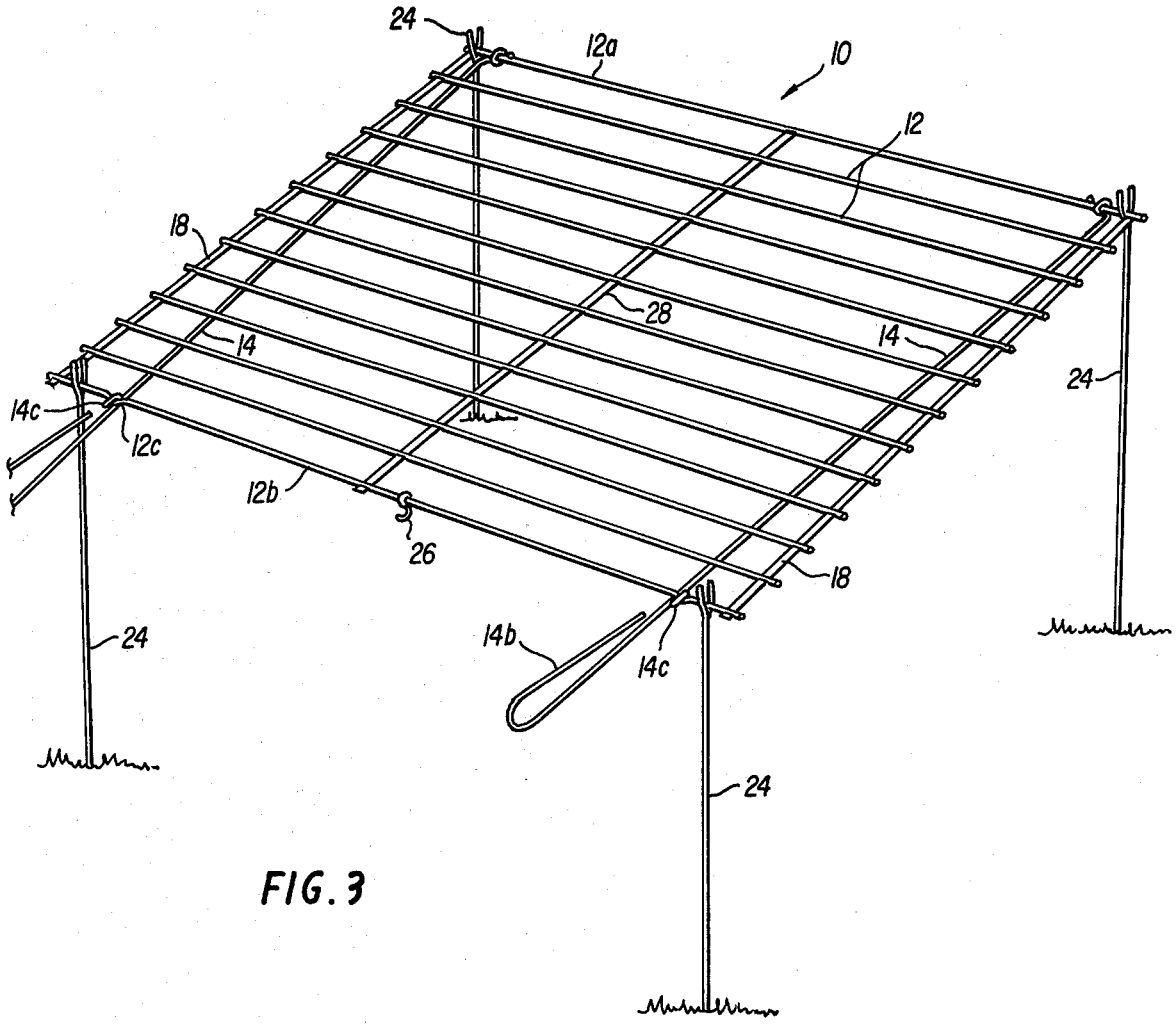
FIG. 3 is a perspective view of the grill of FIG. 1 assembled and set up for use.

Referring to FIGS. 1, 2, and 3, a collapsible grid viewed in FIG. 1 includes a plurality of rigid rods or rod members 12, the top one in FIG. 1 being designated 12*a* and the bottom one in FIG. 1 being designated 12*b*. Each rod is connected to one of a pair of cables 18 in sequence from 12*a* sequentially to 12*b* in like order to cables 18. A pair of pins 16 are attached near the ends of the rod 12*a*.

A pair of rigid bars 14 are connected to the first rod 12*a* by being twisted with turns 14*a* around the rod 12*a*, one near one end of the rod 12*a* between one pin 16 and the attachment of the cable 18, and the other near the other end of the rod 12*a* between the pin 16 near the other end and the attachment of the cable 18. By means of these pins 16 and the turns 14*a*, the bars 14 cannot escape from the rod 12*a*, and are free to slide only a limited distance, the limits being fixed by the pins 16 and the cable 18. Nevertheless, the connection is sufficiently loose to enable the bars to be brought into substantial parallelism with the rods, when disengaged from the detents 12*c*.

At the end remote from the turns 14*a* each bar 14 is provided with a handle 14*b*, for example, as shown, by simply folding back the end portion of the bar. Each bar 14 is also provided with a hook 14*c*, which faces away from the attachment turns 14*c*, and is engaged, when the grid is assembled, as shown in FIG. 1 most clearly, in an indentation 12*c* in the last rod 12*b*, the indentations being suitably spaced apart and near the ends of the rod 12*b*. The distance from the turns 14*a* along the bar 14 to the hook 14*c* should be substantially equal to the length along the cable when stretched straight, from the rod 12*a* to the rod 12*b*, so that the engagement of the hooks 14*c* in the indentations 12*c*, is held as a detent by reason the tension so created in the cables 18. For this purpose indentations 12*c* should be suitably shaped. When the bars 14 are so engaged, they should be non-parallel, as shown in FIG. 1.

One of more further cables, such as the cable shown at 28 and of the same lengths as cables 18, may be lightly attached in any suitable manner, at spaced intervals between the cables 18, to the rods 12, only one such additional cable 28 being shown centrally located along the rods 12. It is desirable to also provide a hook 26 which may consist of a piece of metal twisted around the rod 12*b*, sufficiently open to engage around one of the other rods 12, for a purpose to be described hereinafter.

Figure 5:
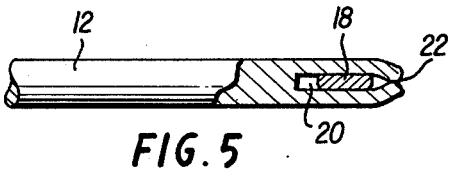
FIG. 5 is a cross-sectional view illustrating a detail of the grill of FIG. 1.
Figure 6:
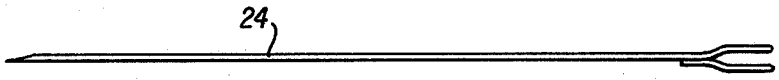
FIG. 6 is a plan view of a stake useful in setting up the grill for use.

Forked supports or stakes 24 may be supplied, each with rather sharpened ends (not too sharp, for safety's sake) at one end and a fork at the other end so that when the grid is assembled as in FIG. 1, the stakes may be driven into the ground to support the grid 10 by a pair for each bar supporting that bar at a spaced interval, as illustrated in FIG. 3. For attachment of the cables 18 to the ends of the rods 12, a rod 12 end may have a slot formed, such as the slot 20 of FIG. 5, one turn of a cable link inserted within the slot (if link cable is used), and then the end of the slot turned over and crimped together to form a crimped end 22 of the rod 12. A similar means of attachment may be used if the cable 18 is a wire cable or the like. One form of cable may be a ribbon of stainless steel which is thus easy to keep clean. The cable must, of course, be flexible to permit rolling. The rods may also be of stainless steel or any other suitable material, but rigid with a slight spring only.

Figure 4:
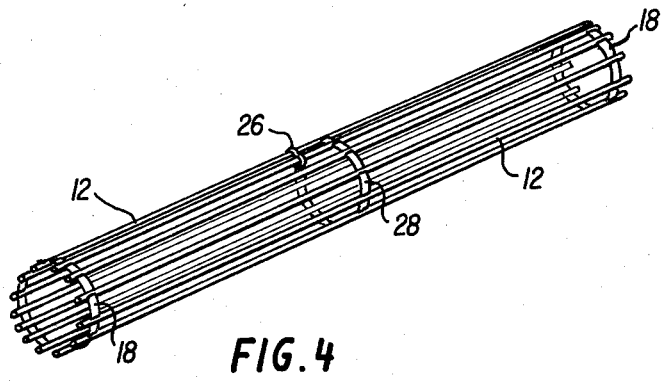
FIG. 4 is a perspective view of the grill of FIG. 1 disassembled and rolled for carrying.

In use the portable grill may come in a roll as shown in FIG. 4. The grill is unrolled, the bars 14 extended transversely of the rods 12, and the hooks 14*c* engaged in the indentations 12*c* as detents, so that the cables 18 are held under tension by spring action of the rod 12*b*, and the bars 14 from the hooks to the turns 14*a* are therefore held under compression, thus forming a stable grid configuration with the rods 12 in a grid array, preferably parallel to each other as determined by the spacings of the rods 1 along the cables 18. The bars 14 should be non-parallel to each other, tending thus to prevent twisting. The stakes 24 may be suitably inserted under the grill 10 and the grill thus mounted for use.

After use and suitable cleaning, the grill may be rolled up, starting from 12*a* on the inside and first enfolding the bars 14 inside. If desired, the stakes 24 may also be enfolded within the roll. When rolled, the hook 26 may be used to grasp one of the inner rods 12 close to the last rod 12*b* so that the roll is maintained without difficulty and may be readily transported. Any suitable expedient, however, may be used to keep the roll together for transportation.

Thus there has been described a portable grill which is exceedingly easy to transport, being compact, the parts of which are easily kept together. Further, desirably there is some spring action of the rods, particularly of the end rod 12*b*. This spring action maintains the bars 14 under compression and the cables 18 under tension. By engaging the bars 14 so that the extension of the line of the bars 14 intersects, a stable shape of the assembled grill 10 is achieved which avoids twisting or turning of the assembly when prepared for grilling. The folded handles 14*b* provide an exceedingly simple form for manufacture. Furthermore, parts of the assembly, except for the stakes, are maintained together, so that they cannot be lost or misplaced. The grid is described is inexpensive, light, compact, and rugged.

What is claimed is:

1. A collapsible grid comprising:

(1) a pair of flexible cables;

(2) a plurality of rigid rods fastened at one end of each rod in ordered sequence beginning with a first rod at one end of one cable and continuing to a second rod at the other end of the one cable, and each remaining rod fastened at the other end to the other cable in like sequence with the first rod at one end of the cable and continuing to the second rod at the other end of the sequence, said second rod having a degree of flexibility;

(3) a pair of bars each connected at one end of the bar to one end of the first rod, said first rod having means near each of its ends to capture the bars between the respective cable and the said means;

(4) said bars each having a receiving hook to removably receive the second of said rod members, and said second bar having a pair of detent means respectively to receive said hooks; and whereby when the hooks receive and engage the second bar member, the rods are under compression and the cables are under tension by spring action of the second bar to spread the rods into an array useful as a grill, and whereby when said rods are disengaged from the hooks the grill is collapsed, the bars and rods may be rolled up and retained by the cable to form a bundle.

2. A grid as claimed in claim 1, said said pair of detent means being positioned to hold said bars in non-parallel positions when engaged by said detents.

3. A grid as claimed in claim 1, said said pair of detent means comprising indentations in said second bar.

4. A grid as claimed in claim 1, said cable being a chain link cable.

5. A grid as claimed in claim 4, one end of each rod being slotted and receiving the cable within the slot, the end of the slot being crimped to retain the cable fastened firmly within the slot.

6. A grid as claimed in claim 1, said cable being of flexible stainless steel.

7. A grid as claimed in claim 1, said one bar having a pin near each end thereof, each of said bar members being fastened slidably on said one bar respectively captured between said pin and one end and the cable by one of the pins.

8. A grid as claimed in claim 7, the slidable fastening being formed by one or more turns of each bar at its end around the one rod.

9. A grid as claimed in claim 1, further comprising a set of four stakes, each stake being forked at one end, for mounting the grid when assembled by placing a bar in each fork of each stake, a pair for each bar at spaced intervals along the bar.

* * * * *